US006789828B1

(12) United States Patent
Borg

(10) Patent No.: US 6,789,828 B1
(45) Date of Patent: Sep. 14, 2004

(54) STABILIZING TWO-BOTTLE CARRIER

(75) Inventor: Zakary J. Borg, Eugene, OR (US)

(73) Assignee: Oregon Precision Industries, Inc., Eugene, OR (US)

( * ) Notice: Subject to any disclaimer, the term of this patent is extended or adjusted under 35 U.S.C. 154(b) by 0 days.

(21) Appl. No.: 10/634,571

(22) Filed: Aug. 4, 2003

(51) Int. Cl.[7] ..... B65D 75/00

(52) U.S. Cl. ..... 294/87.2; 206/151; 206/159; 294/159

(58) Field of Search ..... 206/145, 147, 206/150, 151, 158, 159, 427, 428, 431; 294/87.2, 159

(56) References Cited

U.S. PATENT DOCUMENTS 3,804,309 A * 4/1974 Kwak ..... 294/159
4,033,489 A * 7/1977 Fowler ..... 294/159
4,093,295 A * 6/1978 Erickson ..... 294/87.2
4,566,591 A * 1/1986 Turtschan et al. ..... 206/427
4,634,002 A * 1/1987 Delonghi ..... 206/151
RE35,288 E 7/1996 Borg
5,735,562 A * 4/1998 Borg ..... 206/151

* cited by examiner

*Primary Examiner*—Luan K. Bui
(74) *Attorney, Agent, or Firm*—Chernoff, Vilhauer, McClung & Stenzel, LLP

(57) ABSTRACT

An integrally molded carrier for balanced lifting and carrying of two bottles by their necks and that maintains a space between the bottles so as to prevent collisions between them is disclosed.

11 Claims, 3 Drawing Sheets

STABILIZING TWO-BOTTLE CARRIER

BACKGROUND OF THE INVENTION

Multiple bottle carriers for holding and carrying bottles or jugs by their necks are well known. A common type of commercially available carrier is fabricated from thin gauge sheets of plastic. The thin planar sheet is die-cut to provide holes for engaging the necks of the containers and holes for grasping the carrier, and is thermo-formed into a three-dimensional shape to provide structural integrity to the carrier. There are several problems with this carrier. First, the thermo-formed plastic sheet shrouds the container, obscuring visibility of the product and product labels. Second, the thin gauge and sharp edges of the plastic material makes the carrier uncomfortable to carry.

An integrally molded carrier for carrying two containers by their necks is disclosed in commonly owned U.S. Pat. No. Re 35,288. However, the carrier disclosed therein suffers from the drawback of bending slightly in the grip portion, thereby allowing the containers to collide with each other in their lower portions. When the containers are made of glass, such as is the case with wine bottles, this may result in breakage of the bottles.

U.S. Pat. No. 4,093,295 discloses an in-line design bottle carrier capable of carrying three bottles by their necks by means of three uniformly spaced split collars mounted within a frame interconnected by a single row of longitudinally extending rigid bars. Although the rigid bars tend to prevent the bottles from clanking together, this carrier features two loops that function as handles, which must be pulled up substantially simultaneously and drawn together before they may be grasped by the user, making the balanced lifting of the bottles awkward. These handles also tend to stick up above the necks of the bottles, making the bottle/carrier combination difficult to ship. Finally, the '295 carrier is difficult to apply to groups of three bottles with automated equipment.

BRIEF SUMMARY OF THE INVENTION

The present invention provides an integrally molded carrier for balanced and stabilized lifting and carrying of two bottles by their necks that prevents the lower portions of the bottles from colliding with each other, thereby preventing breakage in the case of glass bottles. The carrier includes a substantially planar web having two nodes defining two annular supports. A flexible annular neck-engaging flange integral with the web is arranged within each annular support for releasably engaging the necks of containers. The centers of the annular supports are substantially aligned along a common axis. Two substantially U-shaped members also lie in the same plane as the web, but are flexibly attached to each side of the two annular supports and may be interlocked so as to form a bottle-engaging stay that maintains separation of the bottles while they are lifted and carried. Because the carrier is molded in one piece and lies in a single plane, it readily lends itself to stacking and shipping in large numbers.

DETAILED DESCRIPTION OF PREFERRED EMBODIMENTS

Figure 1:
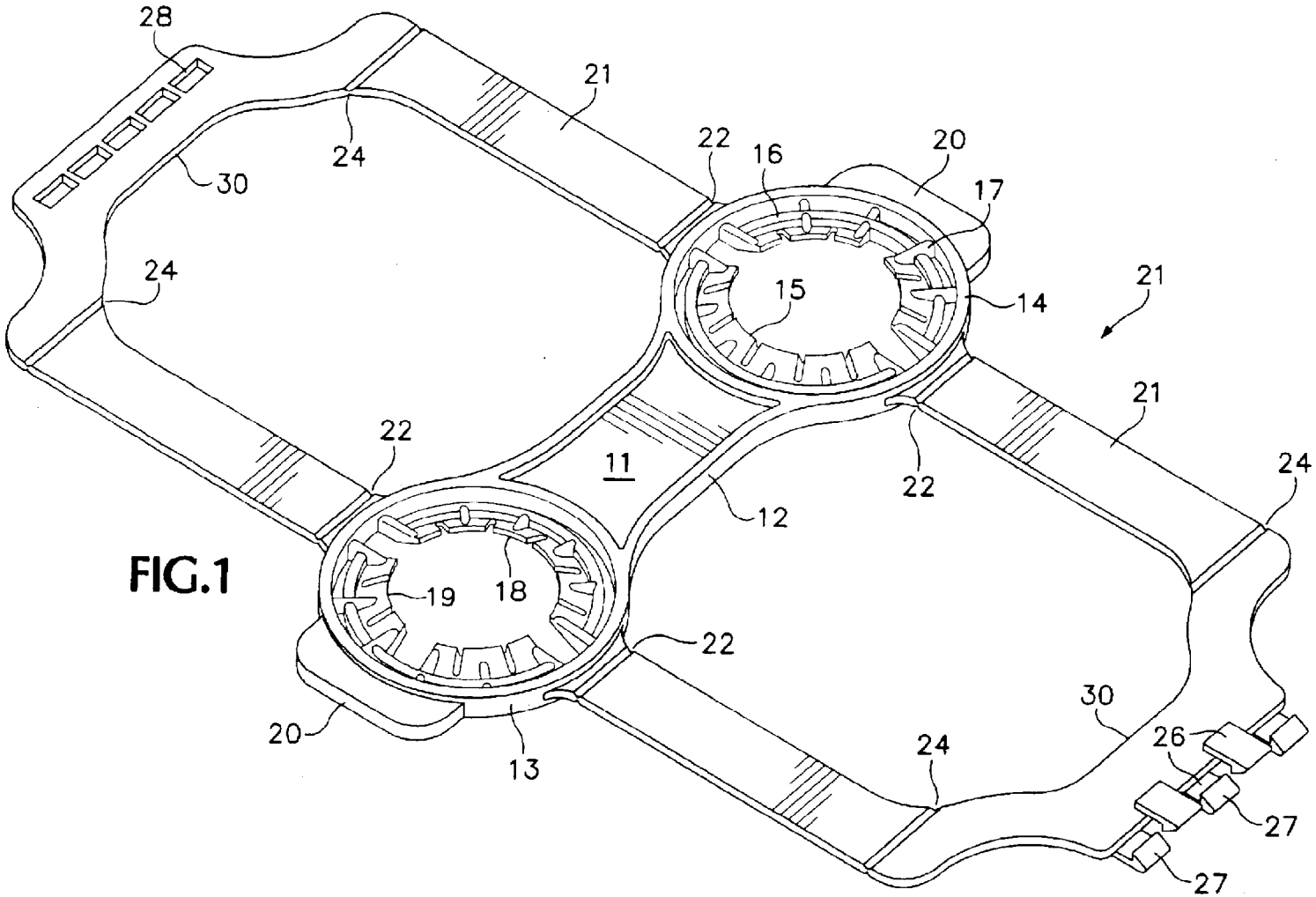
FIG. 1 is a perspective top view of an exemplary carrier of the invention.
Figure 2:
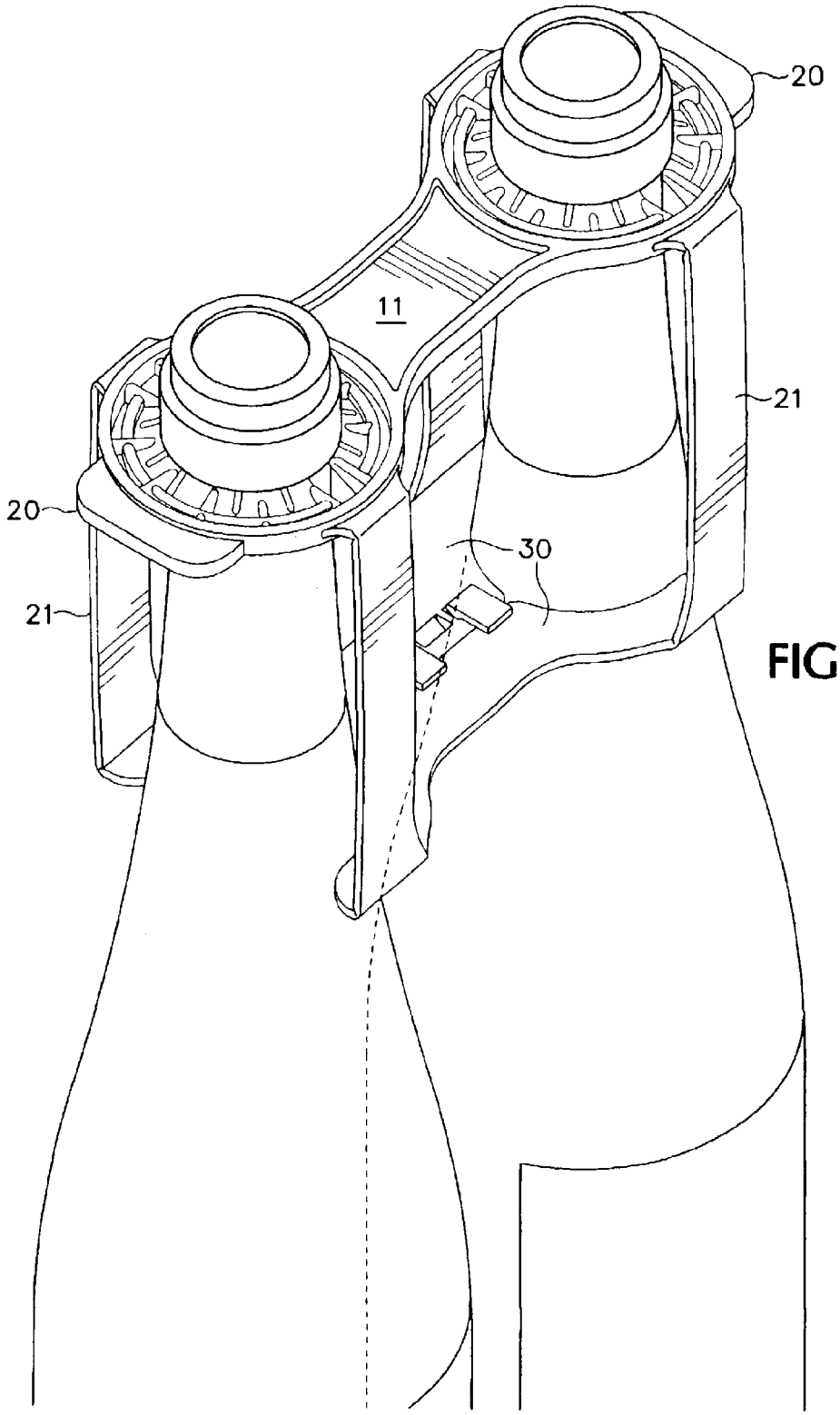
FIG. 2 is a side view of the carrier of FIG. 1 engaging two bottles by their necks and showing the separation of the lower portions of the bottles achieved by the bottle-engaging stay of the carrier.

Referring to the drawings, wherein like numerals generally refer to the same elements, there is shown in FIGS. 1–2 a carrier 10 for carrying two bottles that includes a substantially planar web 11 having two nodes preferably formed from a flexible material such as plastic, preferably high density polyethylene (HDPE), and most preferably recyclable HDPE. The two nodes of web 11 are substantially aligned along a common axis. Web 11 includes an inner portion which is continuous and flat and optional peripheral support ridges 12 along its periphery between the two nodes to provide structural rigidity. Both nodes are provided with identical flexible annular neck-engaging rings 13 that are integral with web 11.

Each neck-engaging ring 13 is provided with an outer circumferential ridge 14 to give structural rigidity, and with an annular flange 15. Annular flange 15 is flexible for ease in placing over and removing the same from, for example, a bottle neck, and may be joined to outer circumferential ridge 14 by inner circumferential ridge 16 and radial ribs 17. Annular flange 15 is frusto-conically shaped so as to flex in an upward direction-when the carrier is pushed in a downward direction over, for example, the necks of bottles and then to bear at an upward angle against the weight of the bottles when the carrier is lifted. Annular flange 15 is optionally provided with inner edge portions 18 that are substantially flat, which make it easier to engage and disengage bottle necks. Annular flange 15 may also be provided with radial relief slots 19, which permit the annular flanges greater flex when the necks of bottles are either engaged or disengaged.

Figure 3:
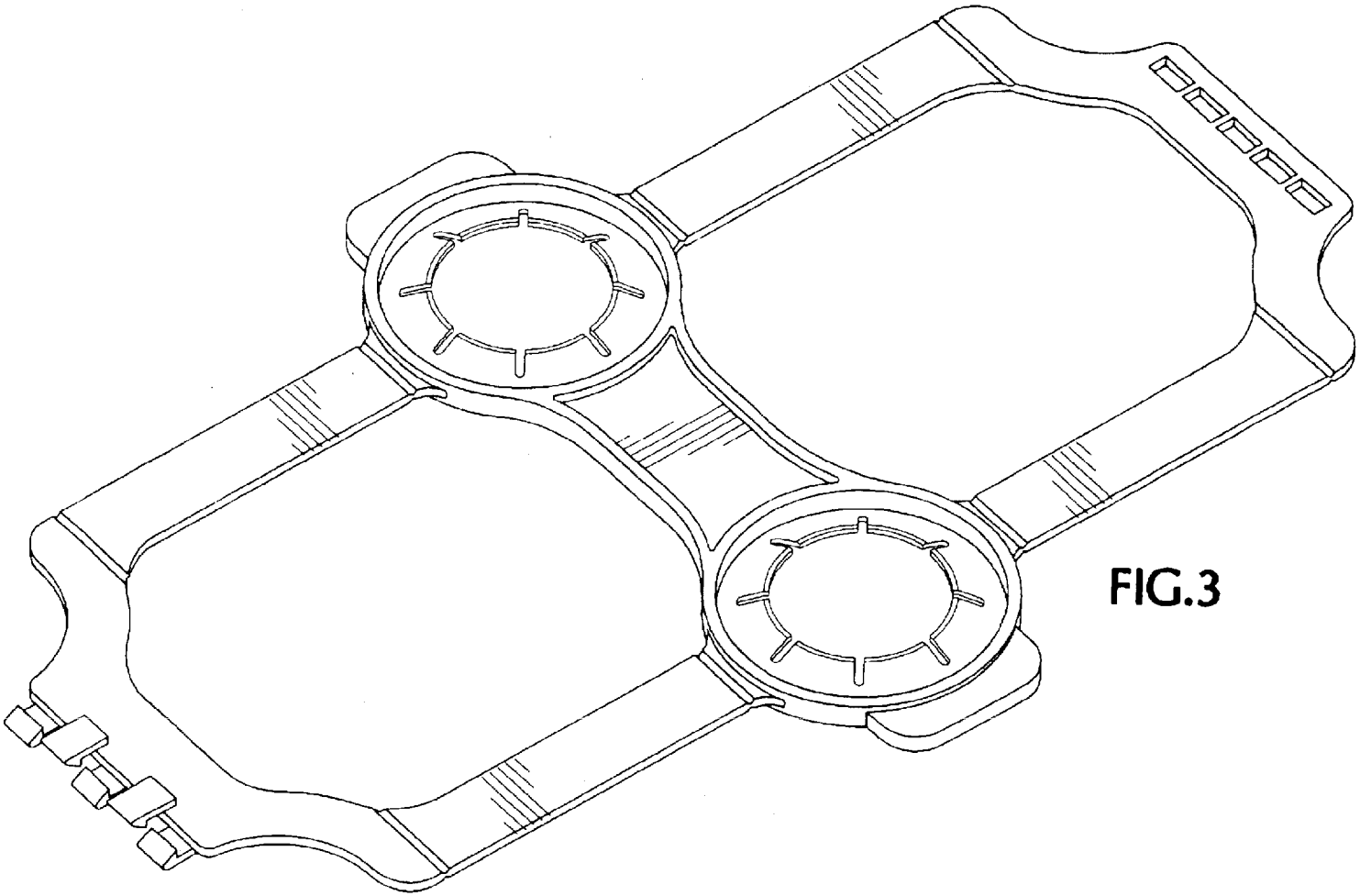
FIG. 3 is a perspective top view of another exemplary carrier of the invention.

The neck-engaging rings 13 are optionally provided with pry tabs 20 (shown in FIGS. 1–2) that help disengage the carrier from bottle necks by prying them up. However, such pry tabs do not form an essential part of the invention, and may be dispensed with altogether, as shown in FIG. 3. Annular flanges 15 may be discontinuous as shown in FIGS. 1–2, or continuous, as shown in FIG. 3.

Still other types of neck-engaging flanges may work as well. For example, flat flanges, not conically shaped, may have enough structural rigidity to grasp and hold the necks of bottles. Nor is it necessary that the flanges be set apart from the annular supporting ribs by radial ribs; the web and the flanges may be integral if the web material is strong enough.

The carrier 10 is provided with two generally U-shaped members 21 that have two sets of flex grooves 22 and 24 that permit them to be bent at substantially right angles in two places so as to permit the U-shaped members to interlock. One U-shaped member is provided with male interlocking members 26, preferably in a staggered arrangement, with each member 26 terminating in a latching portion 27. A preferred configuration for latching portion 27, though not essential, is one having a barbed cross-section, as shown in FIGS. 1 and 3. The other U-shaped member is provided with female interlocking members 28 adapted to securely engage with latching portion 27 of male interlocking members 26. When the two U-shaped members are bent substantially at right angles at flex grooves 22 and 24 and interlocked, arcuate portions 30 engage the bottle necks below the mouths of the bottles so as to form a stay that maintains a space between the lower portions of the bottles to prevent contact between them. This is shown in FIG. 2, which depicts carrier 10 in use.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. An integrally molded carrier for carrying two bottles by their necks, comprising a substantially planar web having two nodes defining two annular supports with each annular support having a flexible annular flange for releasably engaging the necks of the bottles, wherein the centers of the annular supports are substantially aligned along a common axis, and two generally U-shaped interlockable members flexibly attached to said web at each side of said two annular supports, each of said U-shaped members adapted to engage the necks of said two bottles at a point below the tops of said two bottles so as to maintain a space between the lower portions of said two bottles.

2. The carrier of claim 1 wherein said flexible annular flange is provided with radial ribs extending inwardly of said annular supports.

3. The carrier of claim 2 wherein said flexible annular flange comprises a frusto-conical portion.

4. The carrier of claim 3 wherein said flexible annular flange is provided with radial slots.

5. The carrier of claim 4 wherein said flexible annular flange includes substantially flat inner edge portions.

6. The carrier of claim 5 wherein said annular supports are provided with circumferential ridges.

7. The carrier of claim 6 wherein said web is provided with ridges along its periphery.

8. The carrier of claim 1 wherein said U-shaped members are provided with male and female interlocking members.

9. The carrier of claim 8 wherein said U-shaped male interlocking members are in a staggered arrangement relative to each other.

10. The carrier of claim 9 wherein said male interlocking members terminate in barbed latching portions.

11. The carrier of claim 10 made of high density polyethylene.

* * * * *